US005107957A

United States Patent [19]

Bennett

[11] Patent Number: 5,107,957

[45] Date of Patent: Apr. 28, 1992

[54] TRASH LADDER

[76] Inventor: Arthur R. Bennett, 250 Jacaranda Dr., Plantation, Fla. 33324

[21] Appl. No.: 698,979

[22] Filed: May 13, 1991

[51] Int. Cl.[5] ..... B65F 1/00

[52] U.S. Cl. ..... 182/129; 182/33; 312/211; 312/235.1

[58] Field of Search ..... 182/20, 129, 35, 33; 312/211, 235.1

[56] References Cited

U.S. PATENT DOCUMENTS

| | | | |
|---|---|---|---|
| 2,526,767 | 10/1950 | Parker | 155/1 |
| 2,658,640 | 11/1953 | Bayles | 217/5 |
| 2,775,499 | 12/1956 | Gleitsman | 312/235 |
| 3,030,166 | 4/1962 | Richards et al. | 312/235 |
| 3,407,899 | 10/1968 | Delafrange | 182/20 |

FOREIGN PATENT DOCUMENTS

| | | | |
|---|---|---|---|
| 329915 | 5/1930 | United Kingdom | 182/129 |

*Primary Examiner*—Reinaldo P. Machado
*Attorney, Agent, or Firm*—Oltman and Flynn

[57] ABSTRACT

A stepladder arranged to conceal a waste receptacle, wherein the stepladder includes a plurality of horizontal steps disposed at increasing heights; two side panels spaced apart and having indentations forming horizontal edges for supporting the steps, the side panels forming a space for holding the waste receptacle. According to a further feature, the stepladder has at least one of the steps hingedly attached to the side panels for providing an upward-facing opening for accessing the waste receptacle.

9 Claims, 2 Drawing Sheets

TRASH LADDER

The invention relates to a stepladder arranged so that it has space for enclosing a trash receptacle.

BACKGROUND AND PRIOR ART

In modern kitchens there is often only limited space available for locating the various implements required in a household. One implement that is usually required in a household is a stepladder that enables a householder to reach things that are located above normal reaching range. Stepladders, however, usually require a good deal of storage space. Folding stepladders are known, but these are usually wiggly and not very safe to stand on. Another implement that is usually required in a kitchen is a trash receptacle which also requires storage space and is normally unsightly and it is usually wanted to keep it out of sight.

It is therefore a primary object of the present invention to provide an arrangement for storing a stepladder and a waste receptacle in a single common space, and it is another object of the arrangement to conceal the trash receptacle when it is not in use.

Inventors have in the past shown stepladders combined with various other implements. U.S. Pat. No. 2,775,499 shows a stepladder combined with a storage cabinet. U.S. Pat. No. 2,526,767 shows a waste receptacle combined with a kitchen stool.

These patents, however, do not overcome the problems described above, or meet the stated objects.

SUMMARY OF THE INVENTION

In accordance with the invention there is provided a stepladder arranged to conceal a waste receptacle, wherein the stepladder includes a plurality of horizontal steps disposed at increasing heights; two side panels spaced apart and having indentations forming horizontal edges for supporting the steps, the side panels forming a space for holding the waste receptacle.

According to a further feature, the stepladder has at least one of the steps hingedly attached to the side panels for providing an upward-facing opening for accessing the waste receptacle.

According to still another feature, the stepladder has a rearwardly-facing opening for admitting the waste receptacle.

The stepladder according to the invention may include an upper step divided into a forward and a rear part wherein the rear part is rigidly attached to the side panels and the forward part is hingedly attached to the rear part, and wherein further the stepladder includes a lower step and plurality of forwardly disposed vertical spacers disposed between the steps, and a lower vertical spacer adjoining the lower step along an upper edge of the spacer.

The stepladder according to the invention can include at least one rearward facing cross brace disposed between the side panels.

In the stepladder according to the invention at least one of the steps, the side panels, the vertical spacers and the cross brace may be made of wood, e.g. plywood, or plastic, e.g. recycled plastic In the stepladder according to the invention at least two of the steps may be hingedly attached to the side panels for providing a larger upward-facing opening for accessing the waste receptacle.

Further objects and advantages of this invention will be apparent from the following detailed description of a presently preferred embodiment which is illustrated schematically in the accompanying drawings.

DESCRIPTION OF THE PREFERRED EMBODIMENTS

Figure 1:
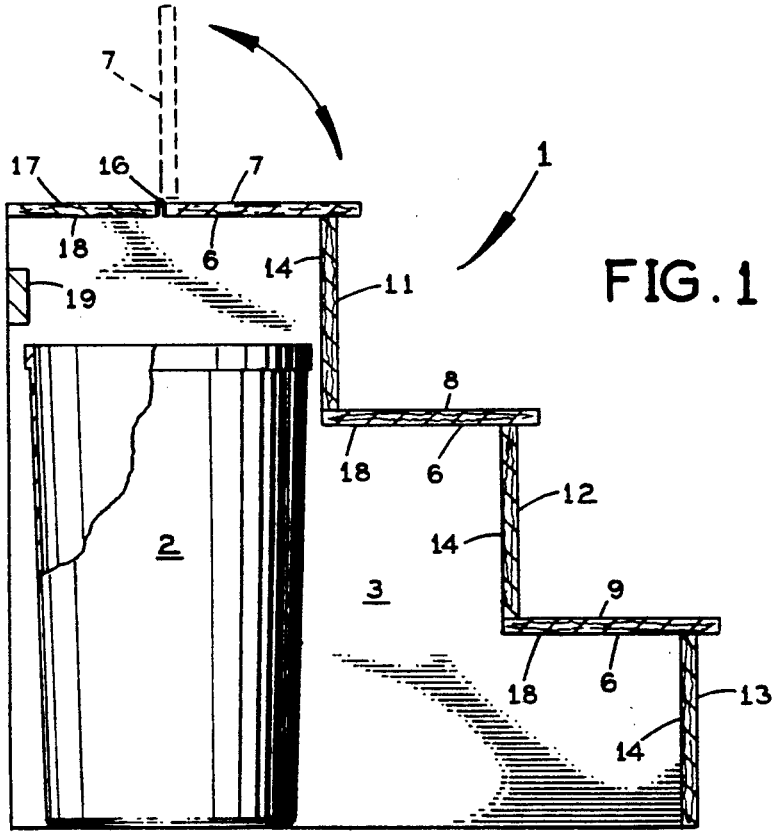
FIG. 1 is an elevational cross-sectional side view of the invention with the wall broken away, seen along the line 1—1 of FIG. 2 show its interior space.
Figure 2:
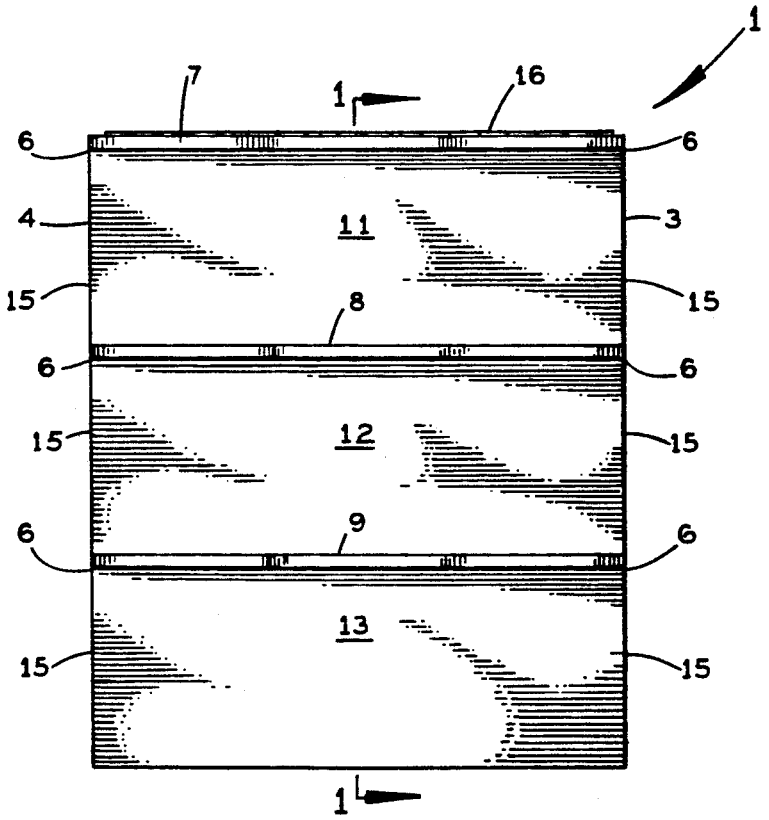
FIG. 2 is an elevational front view of the invention.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

FIGS. 1, 2, 3 and 4 show various elevations of a stepladder 1 according to the invention arranged to conceal a trash receptacle 2 within its interior space.

The stepladder includes two spaced apart side panels 3, 4 that each have step-like indentations that form horizontal upper edges 6, that each supports one of horizontal steps 7, 8, 9, also known as "treads". Each step 7, 8, 9 is supported at its opposite ends on the corresponding edges 6 of the two side panels 3, 4 and rigidly attached thereto.

It follows that any number of steps may be provided rather than just three steps 7, 8, 9 as shown, The spaces between the steps 7, 8, 9 are filled with vertical spacers 11, 12, 13 that are rigidly attached to vertical edges 14 of the step-like indentations in the side panels 3, 4.

The top step 7 is attached by a hinge 16 to a top plate 17, which is rigidly attached to the horizontal top edges 18 of the side panels 3, 4. The top step 7 can be pivoted up, as shown in phantom lines 7 to provide an upward facing access opening to the space for the trash receptacle 2 and for accessing the trash receptacle.

It follows that the top plate 17 could be more narrow, and the top step 7 wider to provide a larger access opening.

A cross brace 19 transversely mounted on the back side of the step ladder 1 adds lateral stability to the stepladder, as do the vertical spacers 11, 12 and 13 that are rigidly attached at their vertical end edges 15 (FIG. 2) to the side panels 3, 4.

Figure 3:
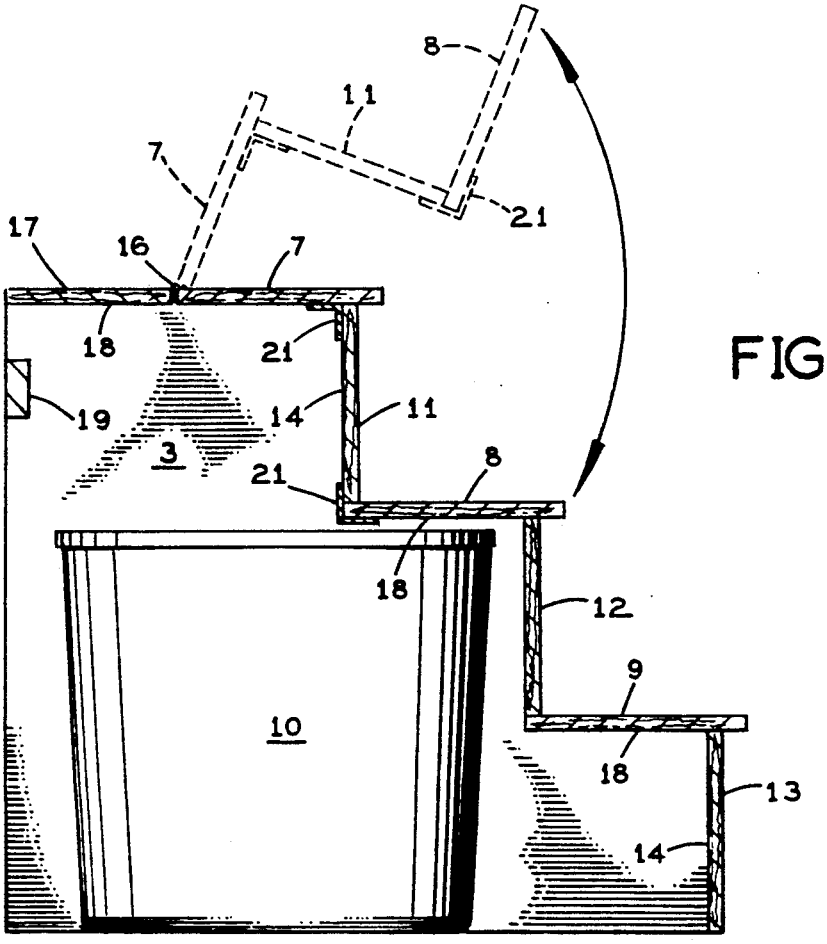
FIG. 3 is another elevational cross-sectional side view of the invention showing two steps hingedly attached to the main ladder structure.

FIG. 3 shows an arrangement wherein the two upper steps 7, 8 and the upper vertical spacer 11 form a single pivotable unit attached to the hinge 16, which, when pivoted upward, as seen in phantom lines 7, 11, 8 in FIG. 3, form a larger upward-facing opening providing more convenient access to a trash receptacle 10, that in this embodiment may be wider and lower, and can, if desired, be inserted and removed through that larger opening.

It follows that in the embodiment of FIG. 3 the assembly formed of steps 7 and 8 and the vertical spacer 11 must be made especially sturdy, for example by means of reinforcing brackets 21 as shown in FIG. 3.

Figure 4:
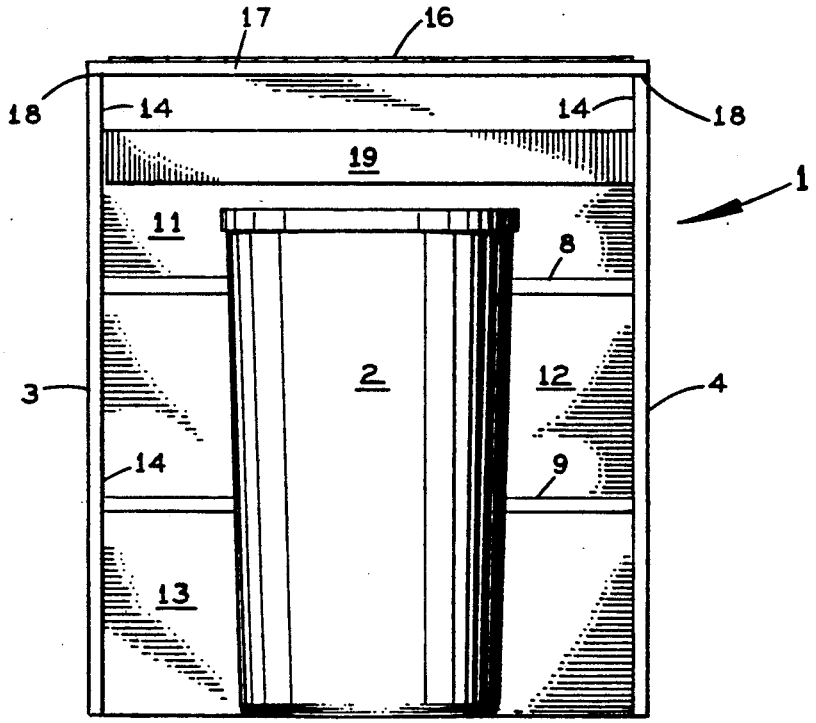
FIG. 4 is an elevational rear view of the invention showing a trash receptacle concealed in the interior space of the step ladder.

FIG. 4 is an elevational rear view of the stepladder according to the embodiment shown in FIG. 1, showing the trash receptacle concealed inside the stepladder.

As seen in the figures, the trash receptacle 2, 10 is structurally unconnected to the stepladder so that the stepladder can easily be pulled forward away from the trash receptacle and used separately as a stepladder, and when not in use as a stepladder, it can be returned to its normal location, for example under a kitchen table or counter where it conceals the trash receptacle.

The stepladder as disclosed may advantageously be made of wood, e.g. plywood, or may alternatively be made of metal, e.g. aluminum, for example in the form of aluminum extrusions spot-welded together. It may also be made of plastic, e.g. recycled plastic.

I claim:

1. A stepladder arranged to conceal a waste receptacle, the stepladder comprising a plurality of horizontal steps disposed at increasing heights; two side panels spaced apart, and having indentations forming horizontal edges for supporting said steps, said side panels forming a space for containing a waste receptacle, and at least one of said steps and side panels form a rearwardly-facing opening for admitting said waste receptacle.

2. A stepladder according to claim 1 wherein at least one of said steps is hingedly attached to said side panels for providing an upward-facing opening for accessing the waste receptacle.

3. A stepladder according to claim 1, including an upper step divided into a forward and a rear part, said rear part rigidly attached to said side panels and the forward part hingedly attached to said rear part.

4. A stepladder according to claim 1, including a lower step, a plurality of forwardly disposed vertical spacers disposed between said steps, and a lower vertical spacer adjoining said lower step along an upper edge of said vertical spacer.

5. A stepladder according to claim 4, including at least one rearward facing cross brace disposed between said side panels.

6. A stepladder according to claim 5, wherein at least one of said steps, said side panels, said vertical spacers and said cross brace are made of wood.

7. A stepladder according to claim 6, wherein said wood is plywood.

8. A stepladder according to claim 5, wherein at least one of said steps, said side panels, said vertical spacers and said cross brace are made of plastic.

9. A stepladder according to claim 2, wherein at least two of said steps are hingedly attached to said side panels for providing an upward-facing opening for accessing the space for the waste receptacle.

* * * * *